US005972874A

United States Patent [19]

Libutti et al.

[11] Patent Number: 5,972,874

[45] Date of Patent: Oct. 26, 1999

[54] STABLE MICROEMULSION CLEANERS HAVING LOW VOLATILE ORGANIC CONTENT

[75] Inventors: Bruce L. Libutti, Teaneck; Joseph Mihelic, Sparta, both of N.J.

[73] Assignee: Ashland Inc., Columbus, Ohio

[21] Appl. No.: 08/835,865

[22] Filed: Apr. 8, 1997

Related U.S. Application Data

[63] Continuation of application No. 08/460,508, Jun. 2, 1995, abandoned.

[51] Int. Cl.[6] ..... C11D 17/00; C11D 9/00

[52] U.S. Cl. ..... 510/417; 510/421; 510/433; 510/437; 510/499; 510/506; 510/245; 510/265

[58] Field of Search ..... 510/417, 416, 510/424, 426, 428, 421, 437, 433, 499, 506, 265, 245

[56] References Cited

U.S. PATENT DOCUMENTS

| | | | |
|---|---|---|---|
| 3,887,497 | 6/1975 | Ulvild | 252/526 |
| 3,928,065 | 12/1975 | Savino | 134/7 |
| 5,158,710 | 10/1992 | Van Eenam | 252/539 |
| 5,281,354 | 1/1994 | Faber | 252/154 |
| 5,401,325 | 3/1995 | Mihelic et al. | 134/39 |
| 5,401,326 | 3/1995 | Mihelic et al. | 134/40 |

*Primary Examiner*—Necholus Ogden
*Attorney, Agent, or Firm*—David L. Hedden

[57] ABSTRACT

This invention relates to stable microemulsion cleaners having decreased volatile organic content comprising (a) a non polar, organic hydrocarbon solvent system comprising (i) an aromatic solvent and/or (ii) an aliphatic solvent, (b) an ethoxylate of an aromatic or aliphatic hydrophobe; (c) a glycol ether or ethylene glycol; a primary amino alcohol; water; and other components for specific applications. These cleaners can be used for removing oil, grease, and baked-on carbon deposits from metal surfaces, and are particularly useful as engine shampoos and cleaners for air coolers.

8 Claims, No Drawings

STABLE MICROEMULSION CLEANERS HAVING LOW VOLATILE ORGANIC CONTENT

This application is a continuation of application Ser. No. 08/460,508, now abandoned filed on Jun. 2, 1995.

FIELD OF THE INVENTION

This invention relates to stable microemulsion cleaners having decreased volatile organic content comprising (a) a non polar, organic hydrocarbon solvent system comprising (i) an aromatic solvent and/or (ii) an aliphatic solvent, (b) an ethoxylate of an aromatic or aliphatic hydrophobe; (c) a glycol ether or ethylene glycol; a primary amino alcohol; water; and other components for specific applications. These cleaners can be used for removing oil, grease, and baked-on carbon deposits from metal surfaces, and are particularly useful as engine shampoos and cleaners for air coolers.

BACKGROUND

The importance of industrial, automotive, and marine cleaners which clean metal parts effectively is clearly recognized. Although such cleaners are available in the marketplace, there is a need for improved cleaners which can be easily handled and used, particularly those which are stable and have reduced amounts of volatile organic compounds. Recently, states like California and New Jersey have enacted legislation which limits the amount of volatile organic compounds in such cleaners. Although solvents with less volatile organic compounds are available for such cleaners, it is difficult to formulate cleaners which are stable mixtures.

Typically the cleaners used for such applications are either solutions or macroemulsion cleaners. However, there are disadvantages in using such products. One of the major disadvantages of these macroemulsion cleaners is that they are not convenient to use since they must be prepared as a water emulsion just prior to use due to the instability of the macroemulsion. Water emulsions are cumbersome to use and a significant source of cleaning failures, especially under shipboard conditions, because they break into two phases. Furthermore, mixing can result in inconsistent results due to variations in the concentration of components of the macroemulsion as prepared.

Another major disadvantage of such cleaners is that they are milky emulsions which leave milky residues on cleaned equipment and require a further water rinse which is undesirable.

Additionally, solution cleaners based upon solvents, and even many macroemulsion cleaners often have low flash points which can be unsafe when the cleaners are used for cleaning hot equipment, particularly air coolers on diesel engine trains. The air cooler of a diesel train is conventionally cleaned using such a freshly prepared macroemulsion in water. The water is added to eliminate the flash point, which would otherwise create a potential hazard on the hot equipment.

Even so, due to the vagaries in macroemulsion preparation on shipboard just prior to use, a potentially hazardous flashpoint may occur. Usually these macroemulsion cleaners are stable for only a few hours. Consequently, if the personnel involved in the cleaning are suddenly needed elsewhere during the course of the air cooler cleaning treatment or do not carry out the macroemulsification properly, the emulsion and water could separate with the result that the emulsion would have reduced cleaning effectiveness.

Additionally, in the engine shampoo formulations, the water and surfactant components aid in the lifting of certain soils from the surfaces, and the water content can improve rinsing.

In addition to these major disadvantages, there are several other deficiencies macroemulsion cleaners have when used to clean industrial and marine equipment:

(a) The cleaners do not drain effectively which results in excessive post rinsing.

(b) The cleaners generate foam during the cleaning process.

(c) Cleaning effectiveness is sometimes inadequate.

(d) These cleaners are available only as a concentrate. The use of such concentrates requires on-site mixing.

The other major class of cleaners consist of detergents in solutions of water or solvents which also have limitations. Water-based formulations are ineffective on oil and soils. Solvent-based detergents possess flash points which render them hazardous when applied to thermally or electrically "live" equipment.

What is needed is a microemulsion cleaner is a stable microemulsion cleaner which overcomes these problems, but which contains reduced volatile organic compounds.

SUMMARY OF THE INVENTION

This invention relates to stable microemulsion cleaners having low volatile organic compounds comprising:

(a) a non polar, organic hydrocarbon solvent system comprising (i) an aromatic solvent and/or (ii) an aliphatic solvent, where the volatile organic content of the solvent system is no more than 50 weight percent, based upon the total weight of the microemulsion cleaner, and the total amount of the solvent system in the stable microemulsion cleaner is from 10 to 65 weight percent;

(b) an ethoxylate of an aromatic or aliphatic compound having a hydrophobic segment having an average molecular weight of about 300 to about 3000 in an amount sufficient to stabilize the microemulsion cleaner;

(c) a glycol ether or ethylene glycol in an amount of 1 to 25 weight percent;

(d) a primary amino alcohol in amount of 0.1 to 10 weight percent; and (e) water in an amount of 10 to 60 weight percent, where said weight percent is based upon the total weight of the ready-to-use microemulsion cleaner, and wherein the total volatile organic content of the microemulsion cleaner is no more than 50.

These microemulsion cleaners are particularly useful as air cooler and heat exchanger cleaners when a minor amount of a defoamer is added to the microemulsion cleaner. They are particularly useful as engine shampoos when a potassium or amine salt of a $C_{16}$ to $C_{22}$ carboxylic fatty acid in an amount of 10 to 30 weight percent and a diethanolamide in an amount of 1 to 5 weight percent is added to the microemulsion cleaner.

These cleaners are used for removing oil, grease, and baked-on carbon deposits from metal surfaces. They show many advantages when compared to the macroemulsion cleaners currently used for industrial and marine cleaning. One of their primary advantages of the microemulsion cleaners of this invention is they contain less than 50 percent by weight of volatile organic compounds (VOC), yet they are stable microemulsions. Formulating cleaners with low VOC which are stable microemulsions is not an easy task.

The cleaners can be formulated as concentrates, or as ready-to-use products by further dilution with water when manufactured. The ready-to-use cleaners do not have to be prepared at the application site, as do the more conventional unstable macroemulsions. The cleaners do not foam and are stable at temperatures up to 74° C. for at least several months. Additionally, the cleaners have decreased odor.

The cleaners are easy to handle, mildly alkaline and have a clear to slightly hazy appearance. Although the cleaners may incorporate organic solvents and volatile corrosion inhibitors which have low flash points, they are safe to use because the addition of the primary amino alcohol increases the flashpoint of the microemulsion cleaner.

These cleaners are used in spray and soak cleaning. They are free draining and no heavy water rinse of cleaned equipment is required since these cleaners do not leave a milky residue. The cleaners also do not have an unpleasant odor as cleaners often do which contain morpholine instead of a primary amino alcohol.

ENABLING DISCLOSURE AND BEST MODE

The organic solvents which are used in the microemulsion cleaners comprise a non polar, organic hydrocarbon solvent system comprising (i) an aromatic solvent and/or (ii) an aliphatic solvent, where the volatile organic content of the solvent system is less than 50 weight percent. Although the organic solvents may be flammable or combustible, their flash points may be increased by the addition of primary amino alcohol and water.

Examples of suitable aromatic solvents are methyl napthalene, and Exxon aromatic solvents 100, 150, and 200, and the naphthalene depleted versions thereof, and aromatic solvents containing substituted mono- and di-alkylnaphthalenes such as Amoco Pansaol AN-3S. Examples of suitable aliphatic solvents are Exxsol D-60, D-80 and D-110 sold by Exxon, Conoco 145, 170 and 200 solvents, and Shell 142HT. Other solvents may be used including unsaturated solvents such as terpenes, for example Glidsol 180 from SCM Glidco, and oxygen-bearing solvents such as the series of esters Exxate 600, 700, 800, 900 1000 and 1300 from Exxon. The preferred solvents are the aromatic and aliphatic solvents.

The total amount of organic solvent used in the ready-to-use cleaner is from 10 to 65 weight percent, preferably from 20–60 weight percent, where said weight percent is based upon the total weight of the microemulsion cleaner.

The stable microemulsion cleaner contains a nonionic surfactant which is an ethoxylate of an aromatic or aliphatic hydrophobe such as a phenyl or substituted phenyl group. Preferably used for environmental reasons are ethoxylates of long chain alcohols having an average molecular weight of about 300 to about 3000. The long chain alcohol is preferably a $C_9$–$C_{11}$ and/or $C_{12}$–$C_{18}$ linear alcohol. The average degree of ethoxylation is 1.0 to 6.0 moles of ethylene oxide per mole of long chain alcohol, preferably 2.0 to 6.0 moles of ethylene oxide. Other nonionic surfactants may be used in conjunction with the long chain ethoxylates provided the HLB of the surfactant system is at least 11, preferably from 12.5 to 13.5. The amount of other nonionic surfactants should not exceed 1 to 10 weight percent based upon the weight of the long chain ethoxylates. Useful linear ethoxylated alcohol surfactants are Shell NEODOL® 91-2.5, 91-6 and 91-8 surfactants. Use of such surfactants results in a stable microemulsion which is stable after several months under storage conditions from ≈25° C. to ≈50° (Table II, formulations 1 and 2.

The use of such linear ethoxylated alcohol surfactants results in improved and stable engine shampoos when compared to other types of nonionic surfactants such as Rexol 25J, which is used in formulation A of Table II. Rexol 25 J is nonylphenol polyethylene glycol ester ethoxylate with 9 moles EO/HLB 13.4 (Rexol 25J). This type of nonionic (glycol ester group) can easily hydrolyze to glycol and weak acid in the water solution/microemulsion such as engine shampoo. The hydrolysis is accelerated by higher product storage temperatures such as 50° C. See Table II. When such hydrolysis occurs the clear microemulsion converts to a cloudy/milky product that is a macroemulsion.

The total amount of nonionic surfactant blend in the ready-to-use microemulsion cleaner is from 1 to 25 weight percent, typically from 1 to 20 weight percent, preferably from 1 to 5 weight percent, or more preferably 3 to 4 weight percent, depending on the application.

Glycol ethers which can be used in the microemulsion cleaners include such as dipropylene glycol monomethylether (DPM) or tripropylene glycol monomethylether (TPM). For purposes of this disclosure and the claims, "glycol ether" shall include ethylene glycol. Preferably used as the glycol ether is DPM. If DPM is used, the amount of glycol ether used in the microemulsion cleaner is from 1 to 25 weight percent, typically 10 to 25 weight percent, preferably 18 to 22 weight percent; and more preferably 2 to 5 percent, depending on the application, where said weight percent is based upon the total weight of the microemulsion cleaner. For the concentrate, the quantity of DPM is preferably from 15–40 weight percent, most preferably 25–35 weight percent. If TPM is used, the amounts used are optimally about 15 percent greater than if DPM is used.

The microemulsion cleaners may also contain a primary alcohol amine in an amount to effectively increase the flash point of the microemulsion cleaner. Generally, the amount of primary amino needed to increase and/or eliminate the flashpoint of the microemulsion cleaner is from 0.1 to 10 weight percent of primary amino alcohol based upon the total weight of the microemulsion cleaner. The weight percent will vary depending upon the basicity of the primary amino alcohol. Weaker bases will require more primary amino alcohol. Although more than 10 weight percent of primary amino alcohol can be used, amounts more than 10 weight percent are not usually cost effective. Preferably used as the primary amino alcohol are 2-amino-2-methyl-1-propanol, 2-amino-2-ethyl-1,3-propanediol, 2-amino-1-butanol, 2-amino-2-methyl-1,3-propanediol, tris (hydroxymethyl) aminomethane, monoethanolamine and 2-dimethyl-amino-2-methyl-propanol. Methylation of primary amino alcohols can yield secondary and tertiary amines. As a result, some of these secondary and tertiary amines may be present in the formulation.

The microemulsion cleaners also contain water. The amount of water in the cleaner depends upon whether one is formulating a concentrate or a ready-to-use cleaner. The amount of water the concentrate is from 1 to 20 weight percent, preferably 5 to 15 weight percent, said weight percent is based upon the total weight of the microemulsion cleaner concentrate.

If the microemulsion cleaners are used as an engine shampoo, they also must contain a potassium or amine salt of a $C_{16}$ to $C_{22}$ fatty carboxylic acid in the amount of 10 to 30 weight percent based upon the total weight of the microemulsion cleaner. They also contain an alkanolamide such as an alkanolamide based on coconut fatty acid and diethanolamine in a 1:1 weight ratio. The alkanolamide is used in an amount of 1 to 10 percent weight percent based upon the total weight of the microemulsion cleaner.

If microemulsion is used to clean air coolers and heat exchangers, they must also contain a defoamer. A wide variety of defoamers can be used in the microemulsion cleaner. Typically used as defoamers are polydimethyl siloxane type compounds. A specific example is Dow Corning Antifoam H-10. The amount of defoamer used in the microemulsion cleaner is from 0.001 to 0.5 weight percent, preferably 0.02 to 0.2 weight percent, most preferably 0.05 to 0.1 weight percent, said weight percent is based upon the total weight of the microemulsion cleaner.

The amount of water used in the ready-to-use cleaner is from 10 to 60 weight percent, preferably 15 to 60, where said weight percent is based upon the total weight of the microemulsion cleaner.

Preferably, the microemulsion ready-to-use cleaners for the air cooler cleaner application comprise:

(a) from about 10 to 30 weight percent of an organic solvent system;

(b) from about 1 to 20 weight percent of a long chain alcohol ethoxylate;

(c) from about 1 to 25 weight percent of a glycol ether or ethylene glycol;

(d) from about 0.1 to 10 weight percent of 2-amino-2-methyl-1-propanol;

(e) from about 0.05 to 0.1 weight percent of a polydimethylsiloxane defoamer;

(f) from about 40 to 55 weight percent of water for the ready-to-use microemulsion cleaner.

All weight percents are based upon the total weight of the microemulsion cleaner.

applications, such as storage tanks, pipes, and internal parts of pumps, including those which require cleaning products that have no flash point.

It is believed that the enhanced cleaning effect of the microemulsion cleaners may relate to the presence of ultrafine droplets, either water-in-oil and/or oil-in water, having diameters of 0.001 micron to 0.01 micron, which are stable in the microemulsion cleaner. The transparency and clarity of the microemulsion cleaner are evidence of this stability.

ABBREVIATIONS

The following abbreviations are used in the Examples:

ALKAMIDE 2127=diethanolamide prepared by reacting coconut fatty acid with diethylamine in a molar ratio of 1:1.

AMP=2-amino-2-methyl-1-propanol

DOWANOL DPM=dipropylne glycol methyl ether

DREWSOL #1=a solvent blend comprising 43% SOLVESSO 100, 57% VARSOL 3139, and 0% EXXSOL D-110, where said percents are percent by weight based upon the weight of DREWSOL #1, and having a KB value of 86.9 and aniline point of 23° C.

DREWSOL #2=a solvent blend comprising 43.72% SOLVESSO 100, 36.73% VARSOL 3139, and 19.55% EXXSOL D-110, where said percents are percent by weight based upon the weight of DREWSOL #2, and having a KB value of 51.2 and aniline point of 52° C.

The amount of aromatic and aliphatic hydrocarbons in DREWSOL #1 and DREWSOL #2 along with the percent VOC is shown in TABLE I:

TABLE I

| % DREWSOL #1 in the standard Engine shampoo | | | % High VOC >0.1 mm Hg at 20° C. Aliphatic hydrocarbons | % high VOC >0.1 mm Hg at 20° C. Aromatic hydrocarbons | |
|---|---|---|---|---|---|
| 58.27 | | | 26.57 | 31.70 | |
| % DREWSOL #2 IN LOW VOC ENGINE SHAMPOO FORMULA IDF | Percent Aromatic hydro-carbons | Percent Aliphatic hydro-carbons | Percent Low VOC <0.1 mm Hg at 20° C. Aliphatic hydrocarbons | Percent High VOC >0.1 mm Hg at 20° C. Aliphatic hydrocarbons | Percent High VOC >0.1 mm Hg at 20° C. Aromatic hydrocarbons |
| 59.65 | 30.42 | 29.23 | 11.66 | 17.57 | 30.42 |

Preferably, the microemulsion ready-to-use cleaners for the engine shampoo application comprise:

(a) from about 30 to 60 weight percent of an organic solvent system;

(b) from about 1 to 5 weight percent of a long chain alcohol ethoxylate;

(c) from about 1 to 5 weight percent of a glycol ether or ethylene glycol;

(d) from about 0.1 to 10 weight percent of 2-amino-2-methyl-1-propanol;

(e) from about 1 to 5 weight percent of a diethanolamide;

(f) from about 10 to 20 weight percent of potassium or amine sale of $C_{16}$ to $C_{22}$ carboxylic fatty acid;

(g) from about 10 to 30 weight percent water for the ready to use microemulsion cleaner.

All weight percents are based upon the total weight of the microemulsion cleaner.

The microemulsion cleaners described here, or their concentrates, can be used in a variety of other cleaning EXXSOL D-110=an aliphatic hydrocarbon solvent consisting of $C_{13}$–$C_{15}$ aliphatic hydrocarbons having boiling points ranging from 247° C. to 267° C., a KB value of 26, and aniline point of about 83° C. sold by EXXON.

MEA=monoethanolamine.

PAMAK=tall oil fatty acid, $C_{18}$ average.

Neodol 91-8=a nonionic surfactant which is the reaction product of $C_9$–$C_{11}$ linear alcohols with ethoxylates averaging 8.2 ethylene oxide units per molecule sold by Shell Oil Company.

Neodol 91-2.5=a nonionic surfactant which is the reaction product of $C_9$–$C_{11}$ linear alcohols with ethoxylates averaging 2.5 ethylene oxide units per molecule sold by Shell Oil Company.

Neodol 91-6=a nonionic surfactant which is the reaction product of $C_9$–$C_{11}$ linear alcohols with ethoxylates, averaging 6 ethylene oxide units per molecule sold by Shell Oil Company.

REXOL 25 J=nonyl phenol polyethylene glycol ester ethoxylate with 9 moles ethylene oxide, HLB=13.4.

SOLVESSO 100=an aromatic solvent consisting of $C_9$–$C_{10}$ alkylbenzenes having boiling points ranging from 152° C. to 174° C., a KB value of 93, and aniline point of about 13° C., sold by EXXON.

VARSOL 3139=a mixed 80/20 ratio of blended aliphatic/aromatic solvents consisting of $C_7$–$C_{14}$ hydrocarbons having boiling points ranging from 149° C. to 196° C., a KB value of 33, and aniline point of about 69° C., sold by EXXON.

EXAMPLES

The examples describe "ready-to-use" microemulsion cleaners and concentrates. The examples designated A–F are controls. The examples designated 1–2 are within the scope of this invention.

Table II gives the formulations of several microemulsion cleaners and their sequence of addition for formulation. The cleaners were prepared by first mixing the DREWSOL #1, DREWSOL #2, PAMAK C-6B, REXOL 25J, NEODOL 91-6, and ALKAMIDE 2127. The first addition of water is then added and the mixture became cloudy with soapy suds. The components are mixed with the water for 30 minutes to disperse the suds.

The KOH solution, ethylene glycol, and monoethanolamine and second addition of water are added. The mixture becomes clear yellow after approximately 30 minutes of mixing. The pH (neat) specification is 8.4 to 9.0 which can be adjusted with monoethanolamine if needed.

After formulating, the cleaners were visually tested for initial stability at 25° C. and at 50° C. The results are shown at the Table II. This table indicates that Examples 1 and 2, which contain the aliphatic hydrocarbon solvent (EXXSOL D-110) and at least three weight percent of the non ionic surfactant (NEODOL 91-6), had a lower VOC than the controls, yet were stable microemulsions. The improved stability from the linear alcohol ethoxylates (Formulations 1 and 2) relative to the ester ethoxylate, REXOL 25 J, (Formulation A) is apparent after 3 months. The cleaning effectiveness of the microemulsion cleaners is shown in Table III.

TABLE II

| COMPONENT | A | B | C | D | E | 1 | F | 2 |
|---|---|---|---|---|---|---|---|---|
| DREWSOL #1 | 58.27 | 43.02 | 0 | 0 | 0 | 0 | 0 | 0 |
| DREWSOL #2 | 0 | 0 | 60.65 | 60.65 | 60.15 | 59.65 | 60.15 | 59.65 |
| EXXSOL D-110 | 0 | 17.63 | 0 | 0 | 0 | 0 | 0 | 0 |
| PAMAK | 14.00 | 14.00 | 14.00 | 14.00 | 14.00 | 14.00 | 14.00 | 14.00 |
| REXOL 25 J | 4.66 | 0 | 0 | 0 | 0 | 0 | 0 | 0 |
| NEODOL 96-6 | 0 | 2.18 | 2.18 | 0 | 2.68 | 3.18 | 2.78 | 3.28 |
| NEODOL 96-8 | 0 | 0 | 0 | 2.18 | 0 | 0 | 0 | 0 |
| ALKAMIDE 2127 | 0.95 | 0.95 | 0.95 | 0.95 | 0.95 | 0.95 | 0.95 | 0.95 |
| REGULAR WATER | 16.65 | 16.65 | 16.65 | 16.65 | 16.65 | 16.65 | 16.65 | 16.65 |
| KOH (45% SOLUTION) | 2.00 | 2.00 | 2.00 | 2.00 | 2.00 | 2.00 | 2.00 | 2.00 |
| ETHYLENE GLYCOL | 3.06 | 3.06 | 3.06 | 3.06 | 3.06 | 3.06 | 3.06 | 3.06 |
| MONOETHANOLAMINE | 0.41 | 0.51 | 0.51 | 0.51 | 0.51 | 0.51 | 0.41 | 0.41 |
| % VOC | 58.68 | 43.53 | 49.00 | 49.00 | 48.75 | 48.50 | 48.65 | 48.40 |
| INITIAL STABILITY at 25° C. | Stable | Stable | Stable | Not Stable | Not Stable | Stable | Stable | Stable |
| INITIAL STABILITY at 50° C. | Stable | Not Stable | Not Stable | Not Stable | Not Stable | Stable | Not Stable | Stable |
| After ≈3 Months Stability at 25° C. | Not Stable* | | | | | Stable** | | Stable** |
| After ≈3 Months Stability at 50° C. | Not Stable* | | | | | Stable | | Stable** |

*At 50° C. formulation A develops white soapy precipitate after ≈1 month; and 25° C. after ≈3 months.
**Formulations 1 and 2 are stable after 3 months at 25° C. and 50° C.

Cleaning tests were performed using the Standard Engine Shampoos and the low VOC shampoo of Example 2 to evaluate their performance on standard soil and bake-on fuel oil. Static Soak Evaluation Test (SSET) procedures used to evaluate the microemulsion cleaners as cleaners for standared soil and baked-on fuel are described as follows:

STATIC SOAK EVALUATION TEST (SSET) FOR CLEANING STANDARD SOIL AND FUEL OIL #6 DEPOSITS

The test procedure for static soak evaluation testing is as follows:

1. Stainless steel coupons (size 7.5×1.30 cm) are coated with fuel oil #6. They are then baked at 50° C. 30 minutes and the weight of the oil on the coupon is measured. Alternatively, standard soil is applied to a thickness of approximately 200 microns. The weight is then measured.

2. Four ounce jars containing candidate cleaners are prepared. Tap water is used as a "blank".

3. The oil or standard soil coated coupons are placed in 4 oz jars. The jars are placed on a counter without shaking. The cleaning is performed at room temperature 25° C.

4. One set of coupons is removed from the cleaning solutions after 2.5, 5.0, 10.0, and 15.0 minutes and laid on flat surfaces. The oil coated coupons are then allowed to dry to a constant weight and the final weight is measured. In the case of standard soil coated coupons, the coupons are then rinsed with tap water and allowed to dry to a constant weight, and then the final weight is measured.

5. Based on weight loss of fuel oil #6 or standard soil, cleaning performance of the cleaners was calculated:

$$\frac{A-B}{A}\times 100 = \%\ \text{oil deposit/standard oil removed}$$

where A is the initial weight of the fuel oil #6 or standard soil and B is the final weight of fuel oil #6 standard soil.

In this test, the # 6 oil was first baked-on the coupon by heating to 50° C. for 30 minutes. The standard soil is applied at room temperature, approximately 25° C. and it is not baked.

The results are shown in Tables III and IV shows that the low VOC shampoo of Example 2 cleans better than the Standard Engine Shampoo on standard soil and baked on fuel #6.

For the Standard Soil Test, the composition of the Standard Soil was:

| Component | Percent |
|---|---|
| Engine Oil 20W50 | 22.5 |
| Gear Oil 80W90 | 22.5 |
| Lubricant Lithium White Grease | 5.0 |
| Sand #20 | 10.0 |
| Bentonite Clay | 0.5 |
| Iron Oxides | 30.0 |
| Pine Soot Carbon Lampblack | 9.5 |
| Total percent | 100.0 |

TABLE III

CLEANING PERFORMANCE FOR REMOVAL OF STANDARD SOIL

| % Removal = Average of two test runs | 2.5 Minutes | 5.0 Minutes | 10.0 Minutes | 15 Minutes |
|---|---|---|---|---|
| Standard Product % Removal Standard Soil | 23.82 | 55.90 | 84.86 | 94.67 |
| LOW VOC ENGINE SHAMPOO of Example 2 % Removal - Standard Soil | 31.77 | 67.62 | 85.85 | 94.39 |

TABLE IV

CLEANING PERFORMANCE FOR REMOVAL OF BAKED-ON FUEL OIL #6

| | CLEANING TIME (Minutes) | | | |
|---|---|---|---|---|
| % Removal = Average of two test runs | 6.91 | 50.0 Minutes | 10.0 Minutes | 15 Minutes |
| ENGINE SHAMPOO (Standard Product) % Baked-on Oil #6 Removal | 4.83 | 43.23 | 75.99 | 89.46 |
| LOW VOC ENGINE SHAMPOO of Example 2 % Baked-on Oil #6 Removal | | 45.16 | 74.11 | 86.13 |

Effect of Microemulsion Cleaners on Painted Surfaces

The effect of the cleaners on the exterior clear coat and engine automotive paints was determined by placing two drops of the cleaner of Example 1 on the painted surface at 25° C. and leaving the cleaners on the painted surface for one hour. Thereafter, the cleaner was removed with tap water by rinsing it from the painted surface. The surface is allowed to dry and observations regarding the finish of the paint were recorded. Over 17 paints from several manufactures were tested. The cleaner did not damage the paint, and there was no significance difference in effect between the cleaner of Example A, which used the standard solvents having higher VOC.

We claim:

1. A ready-to-use stable microemulsion cleaner consisting essentially of:

(a) a compound selected from the group consisting of a glycol ether, ethylene glycol, or mixtures thereof in an amount of 1 to 25 weight percent;

(b) a non polar, organic hydrocarbon solvent system comprising an organic compound which is not included in component (a) selected from the group consisting of aromatic solvents, aliphatic solvents, and mixtures thereof, where the volatile organic content of the solvent system is no more than 50 weight percent, based upon the total weight of the microemulsion cleaner, and the total amount of the solvent system in the stable microemulsion cleaner is from 10 to 65 weight percent;

(c) an ethoxylate of an aromatic or aliphatic compound having a hydrophobic segment, where the average molecular weight of said ethoxylate is from about 300 to about 3000 in an amount sufficient to stabilize the microemulsion cleaner;

(c) a primary amino alcohol in amount of 0.1 to 10 weight percent; and (d) water in an amount of 10 to 60 weight percent, where said weight percent is based upon the total weight of the ready-to-use microemulsion cleaner, and wherein the total volatile organic content of the microemulsion cleaner is no more than 50 weight percent.

2. The ready-to-use microemulsion cleaner of claim 1 which additionally contains:

(a) a potassium or amine salt of a $C_{16}$–$C_{22}$ carboxylic fatty acid in an amount of 10 to 30 percent; and (b) a alkanolamide in an amount of 1 to 10 percent.

3. The ready-to-use microemulsion cleaner of claim 2 wherein:

(a) the organic solvent is used in an amount of from 30 to 60 weight percent;

(b) the ethoxylate comprises from about 1 to 5 weight percent of said cleaner and is a linear alcohol having a carbon chain selected from the group consisting of $C_9$–$C_{11}$, $C_{12}$–$C_{18}$, or mixtures thereof, ethoxylated with an average of 5.0 to 6.0 moles of ethylene oxide;

(c) the glycol ether is in an amount of from 1 to 5 weight percent;

(d) the primary amino alcohol is 2-amino-2-methyl-1-propanol in an amount of 0.1 to 10 weight percent;

(e) the alkanolamide is a diethanolamide in an amount of 1 to 5 percent; and (f) water in an amount of from 10 to 30 weight percent, said weight percent being based upon the total weight of the ready-to-use cleaner.

4. The microemulsion cleaner of claim 1 which also contains a defoamer in the amount of 0.001 to 0.5 weight percent.

5. The ready-to-use microemulsion cleaner of claim 4 wherein:

(a) the organic solvent is used in an amount of from 10 to 30 weight percent;

(b) the ethoxylate comprises from about 1 to 20 weight percent of said cleaner and is a linear alcohol having a carbon chain selected from the group consisting of $C_9$–$C_{11}$, $C_{12}$–$C_{18}$, or mixtures thereof, ethoxylated with an average of 5.0 to 6.0 moles of ethylene oxide;

(c) the glycol ether is used in an amount of from 1 to 25 weight percent;

(d) the primary amino alcohol is 2-amino-2-methyl-1-propanol in an amount of 0.1 to 10 weight percent;

(e) water in an amount of from 40 to 55 weight percent, said weight percent being based upon the total weight of the ready-to-use cleaner.

6. A microemulsion cleaner concentrate consisting essentially of:

(a) a compound selected from the group consisting of a glycol ether, ethylene glycol, or mixtures thereof in an amount of 1 to 25 weight percent;

(b) a non polar, organic hydrocarbon solvent system comprising an organic compound which is not included in component (a) selected from the group consisting of aromatic solvents, aliphatic solvents, and mixtures thereof, where the volatile organic content of the solvent system is no more than 50 weight percent, based upon the total weight of the microemulsion cleaner, and the total amount of the solvent system in the stable microemulsion cleaner is from 20 to 65 weight percent;

(c) an ethoxylate of an aromatic or aliphatic compound having a hydrophobic segment, where the average molecular weight of said ethoxylate is from about 300 to about 3000 in an amount sufficient to stabilize the microemulsion cleaner;

(c) a primary amino alcohol in amount of 0.5 to 10 weight percent; and (d) water in an amount of 1 to 20 weight percent, where said weight percent is based upon the total weight of the concentrate microemulsion cleaner, and wherein the total volatile organic content of the microemulsion cleaner is no more than 50 weight percent.

7. The microemulsion cleaner concentrate of claim 6 which also contains a defoamer in the amount of 0.001 to 0.5 weight percent.

8. The microemulsion cleaner concentrate of claim 6 which also contains:

(a) a potassium or amine salt of a $C_{16}$–$C_{22}$ carboxylic fatty acid in an amount of 10 to 30 percent; and (b) an alkanolamide in an amount of 1 to 10 percent.

* * * * *